United States Patent [19]

Hany et al.

[11] 3,955,493

[45] May 11, 1976

[54] FRICTION DISC SPINDLE PRESS

[75] Inventors: Harald Hany, Kassel; Gerhard Broder, Dusseldorf, both of Germany

[73] Assignee: Franz Berrenberg, Haan, Germany

[22] Filed: Aug. 19, 1974

[21] Appl. No.: 498,587

[30] Foreign Application Priority Data

Aug. 20, 1973 Germany ..... 2341945

[52] U.S. Cl. ..... 100/289; 308/174

[51] Int. Cl.[2] ..... B30B 1/18

[58] Field of Search ..... 100/289; 425/352, 346; 308/174, 207 R, 208, 212; 74/194, 196

[56] References Cited

UNITED STATES PATENTS

| | | | |
|---|---|---|---|
| 1,449,849 | 3/1923 | Zeh | 74/194 |
| 1,707,001 | 3/1929 | Georg | 74/194 |
| 2,155,897 | 4/1939 | Goldsworthy | 308/174 |
| 2,379,540 | 7/1945 | Morris | 74/194 |
| 2,770,862 | 11/1956 | Miller | 100/289 |
| 3,044,138 | 7/1962 | Lesnett, Jr. et al. | 100/289 |

*Primary Examiner*—Samuel Scott
*Assistant Examiner*—A. Russell Burke
*Attorney, Agent, or Firm*—Walter Becker

[57] ABSTRACT

A friction disc spindle press which has a countershaft with two side discs rotatably but axially nondisplaceably connected to the end portions respectively of the countershaft which latter is axially displaceably mounted in the press frame. Each end of the countershaft, by means of a self-aligning radial bearing and a self-aligning axial bearing is journaled in a displaceable bushing which, in its turn, is displaceably guided in the press frame.

6 Claims, 1 Drawing Figure

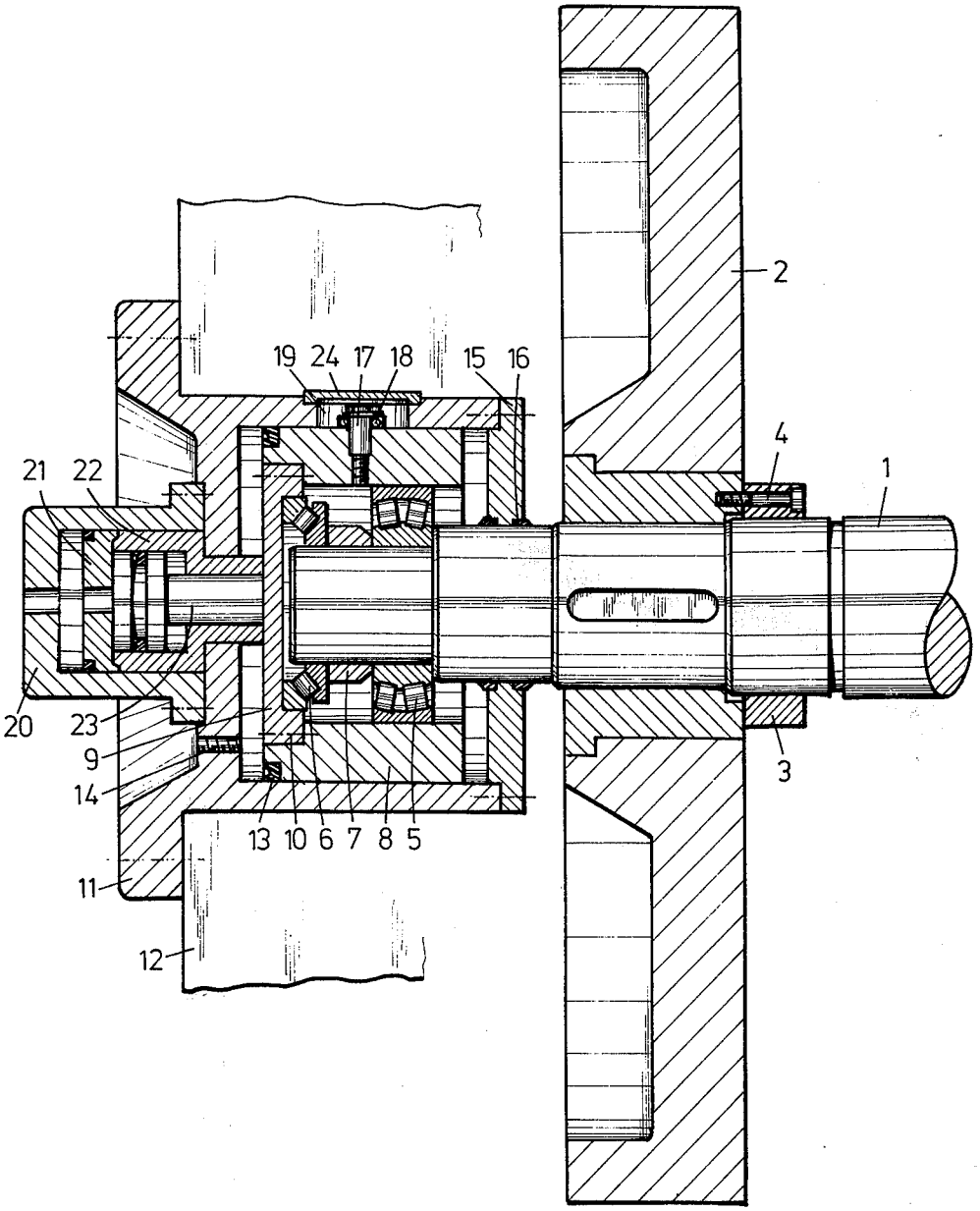
2
19
24
17
18
15
16
4
1
21
22
20
23
9
14
13
10
6
7
8
5
3
11
12

FRICTION DISC SPINDLE PRESS

The present invention relates to a frictional disc screw press with a press spindle guided in the press frame and equipped with an intermediate disc which is adapted to be driven by either one of two side discs which are connected to a countershaft and which together with the countershaft are rotatable as well as axially displaceably mounted on the press frame. Various designs of frictional disc screw presses of the above mentioned type have become known. While according to one design the two side discs that alternately cooperate with the intermediate disc are nonrotatably and axially non-displaceably connected to the countershart so that for purposes of reversing the direction of rotation of the press spindle, the countershaft has to be axially displaced with the two side discs, with other designs the side discs are axially displaceably mounted individually and independently of each other on the countershaft or are together with parts of the countershaft axially displaceably arranged.

In order to increase the gross impact energy of the heretofore known frictional disc screw presses and also the impact speed of the press spindle it is necessary to keep the mass inertia moment of the intermediate disc as low as possible so that a considerably higher speed of the countershaft can be obtained. In order to make sure that the drop in speed of this countershaft and the electro-motoric driving output may be kept low, it is necessary to store a high kinetic energy in the side discs which energy amounts to from 8 to 10 times the gross energy. As a result of all of these steps, the bearings for the countershaft and for the side discs are subjected to higher loads.

Since with frictional disc screw preses or spindle presses of the above mentioned type with side discs connected to the countershaft, the countershaft is displaced from its zero position in which the side discs do not engage the intermediate disc, for driving the press spindle axially in such a way that one side presses disc engages under the required pressure the intermediate disc and the bearings are subjected to additional loads. These loads reach considerable height because the lateral pressing-on pressure of the side disc against the intermediate disc must be such that also the maximum acceleration at the lower rim of the side disc will be transmitted and after a short slipping period synchronism between side disc and intermediate disc will have to be realized. In view of this load, the countershaft bends in the central region up to several millimeters. In the bearings, this bending results in a deviation of the angle which deviation may reach up to 10 angle minutes and may even exceed same. The end pressures caused thereby will with heretofore known frictional disc spindle presses bring about damage to the bearings. In order to avoid such damage, it is necessary to limit the output of the frictional disc spindle press.

It is an object of the present invention to provide a frictional disc spindle press of the above mentioned general type with a high gross impact energy, in which the bearings in spite of the above described loads will be protected against end pressure or edge pressure and other damage without the necessity of employing specially designed and manufactured bearings.

This object and other objects and advantages of the invention will appear more clearly from the following specification in connection with the accompanying drawing diagrammatically illustrating a longitudinal section through the bearing of the countershaft of a frictional disc spindle press in conformity with the present invention.

This frictional disc spindle press according to the invention is characterized primarily in that each end of the countershaft is by means of a radial bearing and an axial spindle bearing journaled in a displaceable bushing which in its turn is displaceably guided in a bearing housing which is connected to the press frame. By employing commercially obtainable self-aligning bearings for the radial and axial journaling of the countershaft, a relatively inexpensive construction is obtained which makes it possible reliably to absorb all loads on the countershaft including bendings because the sliding bushing employed in conformity with the invention has a large bearing surface which will be able to eliminate damage and undue wear with the axial displacement.

According to a further feature of the invention, the slideable bushings are designed as pistons, whereas the bearing housing is designed as a cylinder of an adjusting cylinder operable to bring about the axial displacement of the countershaft so that the mounting according to the invention is adapted simultaneously to be used as adjusting element for the countershaft.

In order to be able quickly and precisely to locate the countershaft in its zero position, it is suggested according to a further feature of the invention to place the displaceable bushings under load by respective pressure rods bringing about the zero positioning of the countershaft which pressure rods, according to the preferred embodiment of the invention are provided with a spring-loaded adjusting piston or an adjusting piston under the influence of a pressure medium and also provided with an abutment surface which in a zero position engage a surface of the bearing housing.

According to the present invention, it is furthermore suggested within the pressure rods to provide pressure bolts which are continuously under load in axial direction and which bring about a preload of the self-adjusting axial bearings. In this way, a shock-like starting of the axial self-adjusting bearings will be avoided which would otherwise result in a very high wear due to the high acceleration and due to the automatically occurring slip between the bearing parts.

The frictional disc spindle press according to the invention makes possible a considerable increase in the gross impact energy while simultaneously reducing the load on the bearing whereby the life span of the bearings is increased and idling times of the press are reduced.

Referring now to the drawing in detail, the construction shown therein illustrates a portion of the countershaft 1, and more specifically the left hand end piece, upon which by means of a groove-key connection there is non-rotatably mounted a side disc 2, which is arrested in axial direction by means of a screw ring 3. The screw ring is by means of a screw 4 connected to the side disc 2.

Placed upon the outermost end of the countershaft 1 is a radial, self-aligning bearing 5 and an axial self-aligning bearing 6. Between the inner rings of these bearings 5 and 6 there is arranged a spacer ring 7. The outer rings of both anti-friction bearings are fitted into a displaceable bushing 8 which is closed at its end face by a piston cover 9 which latter is connected to the bushing 8 by means of screws 10.

The bushing 8 is displaceably mounted in a bearing housing 11 which is supported by the press frame 12. On that end which is adjacent the cover, the bushing 8 is provided with an annular seal 13 so that the bushing 8 closed by the piston cover 9 serves as piston while the cylindrically bored bearing housng 11 serves as cylinder housing of an adjusting cylinder which is supplied with a pressure medium through a connection 14. In order to prevent the pressure medium from escaping, a sealing disc 15 with lip sealings 16 is connected to the rear end of the bearing housing 11.

In order to prevent the bushing 8 from rotating, the bushing 8 is provided with a radially extending bearing bolt 17 having a ball bearing 18 arranged thereon. The ball bearing 18 runs in an axial groove 19 of the bearing housing 11 which is closed by a cover 24. The ball bearing 18 which is axially displaceable in groove 19 thus permits an axial displacement of the bushing 8 but prevents a movement of bushing 8 in circumferential directon.

An additional housing 20 is located at the end face side of the bearing housing 11 and has displaceably movable therein an adjusting piston 21. This piston 21 is connected to a pressure rod 22 which through a bore of the bearing housing 11 acts upon the piston cover 9 and together with the pressure rod 22 of the oppositely located mounting of the countershaft 1 brings about the zero position of the countershaft 1.

On the interior of the pressure rod 22 which is provided with a stepped bore there is arranged a pressure bolt 23 which is likewise acted upon by the pressure medium which acts upon the piston 21 so that the pressure bolt 23 brings about a continuous preload of the axial self-aligning bearing 6.

The countershaft 1 with the side discs 2 connected thereto is thus journaled on the press frame 12 through the intervention of the radial and axial self-aligning bearings 5 and 6, the displaceable bushing 8 and the bearing housing 11. The zero position of the countershaft 1 and the side disc 2 is realized by the fact that the adjusting pistons 21 which through the bushings 8 act upon the two ends of countershaft 1 are acted upon by a pressure medium while the two pressure rods engage a surface of the bearing housing 11 as indicated in the drawing. An axial displacement of the countershaft 1 and thus of the side disc 2 is effected by an action upon either the left hand (with regard to the drawing) or the non-illustrated right hand piston cover 9 whereby the bushings 8 are within the respective bearing housing 11 moved in axial direction and in this way take along the radial and axial self-aligning bearings 5 and 6 as well as the countershaft 1. Since the adjusting pistons 21 and therefore the pressure bolts 23 are continuously under the load of a pressure medium, the pressure bolts 23 bring about a continuous preload of the axial self-aligning bearings 6 so that the latter will also in zero position of the countershaft 1 rotate at the speed of the latter and will not have to be accelerated only when a side disc 2 engages the non-illustrated central disc.

It is, of course, to be understood that the present invention is, by no means, limited to the specific showing in the drawing, but also comprises any modifications within the scope of the appended claims.

What we claim is:

1. A friction disc spindle press having a press frame, which includes: a countershaft having two ends and being axially displaceably arranged in said press frame, two side discs spaced from each other in the axial direction of said countershaft and fixedly connected thereto for rotation and axial movement therewith, two pairs of antifriction bearings respectively mounted on the two ends of said countershaft for supporting the latter, each of said pairs comprising a self-aligning radial bearing and a self-aligning axial bearing, two bushing means respectively associated with said pairs of antifriction bearings and having the latter mounted therein, and two bearing housing means respectively associated with said bushing means and reciprocably slidably supporting said bushing means.

2. A press according to claim 1, in which said bushing means form fluid operable piston means, and in which said bearing housing means form cylinder means for said fluid operable piston means.

3. A press according to claim 2, which includes fluid operable pressure rod means respectively associated with and operable to act upon the respective adjacent bushing means to selectively place said countershaft into its zero position.

4. A press according to claim 3, which includes means respectively associated with said rod means for continuously urging said countershaft means to its zero position.

5. A press according to claim 4, in which said piston means have a step for abutment with the respective adjacent bearing housing means in response to said pressure rod means reaching a position corresponding to the zero position of said countershaft.

6. A press according to claim 3, in which said pressure rod means have an axial bore therethrough, and which includes pressure bolt means extending through said bore and operable to continuously engage said bearing housing means so as to place said self-aligning axial bearing under preload.

* * * * *